US009410432B2

(12) United States Patent
Matsumoto et al.

(10) Patent No.: US 9,410,432 B2
(45) Date of Patent: Aug. 9, 2016

(54) TURBINE

(71) Applicant: MITSUBISHI HEAVY INDUSTRIES, LTD., Tokyo (JP)

(72) Inventors: Kazuyuki Matsumoto, Tokyo (JP); Yoshihiro Kuwamura, Tokyo (JP); Hiroharu Oyama, Tokyo (JP); Yoshinori Tanaka, Tokyo (JP)

(73) Assignee: Mitsubishi Hitachi Power Systems, Ltd., Kanagawa (JP)

( * ) Notice: Subject to any disclaimer, the term of this patent is extended or adjusted under 35 U.S.C. 154(b) by 778 days.

(21) Appl. No.: 13/753,910

(22) Filed: Jan. 30, 2013

(65) Prior Publication Data

US 2013/0251534 A1 Sep. 26, 2013

(30) Foreign Application Priority Data

Mar. 23, 2012 (JP) ..... 2012-067893

(51) Int. Cl.
*F01D 5/12* (2006.01)
*F01D 5/14* (2006.01)
*F01D 11/10* (2006.01)

(52) U.S. Cl.
CPC *F01D 5/12* (2013.01); *F01D 5/147* (2013.01); *F01D 11/10* (2013.01); *F05D 2240/307* (2013.01); *F05D 2250/28* (2013.01)

(58) Field of Classification Search
CPC ..... F01D 11/02; F01D 11/00; F01D 5/20; F01D 5/225
USPC ..... 415/173.1, 173.5, 173.6, 174.5
See application file for complete search history.

(56) References Cited

U.S. PATENT DOCUMENTS 7,971,882 B1 * 7/2011 Liang ..... F01D 11/02 277/418
2009/0072487 A1 3/2009 Chougule et al.

FOREIGN PATENT DOCUMENTS

| | | | |
|---|---|---|---|
| CN | 2725533 Y | 9/2005 | |
| DE | 2462465 A1 * | 4/1977 | ..... F01D 11/02 |
| JP | 2002-228014 | 8/2002 | |
| JP | 2006-291967 | 10/2006 | |
| JP | 2008-223660 | 9/2008 | |

(Continued)

OTHER PUBLICATIONS

International Search Report mailed Apr. 16, 2013 in International (PCT) Application No. PCT/JP2013/052341 with English translation.

(Continued)

*Primary Examiner* — Nathaniel Wiehe
*Assistant Examiner* — Cameron Corday
(74) *Attorney, Agent, or Firm* — Wenderoth, Lind & Ponack, L.L.P.

(57) ABSTRACT

A plurality of stepped parts which have step surfaces facing an upstream side in a rotating axial direction of a structural member are provided in a tip portion of a blade, and seal fins which extend toward a circumference surface of each of the stepped parts and form small clearances between the seal fin and the circumference surface corresponding to the each of the stepped parts is provided in the structural member. Also, lengths from the small clearance to the step surface on the upstream side along the rotating axial direction of the structural member are set such that one of the stepped parts on the downstream side is smaller than the other one of the stepped parts on the upstream side.

6 Claims, 7 Drawing Sheets

(56) References Cited

FOREIGN PATENT DOCUMENTS

| | | |
|---|---|---|
| JP | 2011-12631 | 1/2011 |
| JP | 2011-080452 | 4/2011 |
| JP | 2011-208602 | 10/2011 |
| JP | 2011-247158 | 12/2011 |
| JP | 2012-132397 | 7/2012 |
| WO | 2012/036068 | 3/2012 |

OTHER PUBLICATIONS

Written Opinion of the International Searching Authority mailed Apr. 16, 2013 in International (PCT) Application No. PCT/JP2013/052341 with English translation.

Chinese Office Action issued May 5, 2015 in corresponding Chinese Patent Application No. 201380015074.6 with partial English translation.

* cited by examiner

TURBINE

TECHNICAL FIELD

The present invention relates to a turbine, for example, that is used in power plants, chemical plants, gas plants, iron mills and marine vessels. Priority is claimed on Japanese Patent Application No. 2012-067893 filed Mar. 23, 2012, the content of which is incorporated by reference herein.

BACKGROUND ART

As a well-known type of steam turbine, one is known which is provided with a casing, a shaft body (rotor) installed inside the casing so as to be rotatable, a plurality of turbine vanes arranged by being fixed to an inner circumference portion of the casing and a plurality of turbine blades radially installed at the shaft body in the downstream side of the plurality of turbine vanes. Of these steam turbines, an impulse turbine converts pressure energy of steam (fluid) to velocity energy by turbine vanes and also converts the velocity energy to rotational energy (mechanical energy) by turbine blades. Further, in a reaction turbine, pressure energy is converted to velocity energy also inside turbine blades and the velocity energy is converted to rotational energy (mechanical energy) by reaction force derived from ejection of steam.

In the above-described types of steam turbines, normally, a clearance is formed in the radial direction between the tip portion of a turbine blade and a casing which surrounds the turbine blade to form a flow channel of steam. A clearance is also formed in the radial direction between the tip portion of a turbine vane and a shaft body. However, leakage steam passing to the downstream side through the clearance between the tip portion of the turbine blade and the casing does not impart torque to the turbine blade. Furthermore, in leakage steam which passes to the downstream side through the clearance between the tip portion of the turbine vane and the shaft body, pressure energy thereof is not converted to velocity energy by the turbine vane. Therefore, torque is hardly imparted to the turbine blade on the downstream side. Therefore, in order to improve the performance of a steam turbine, it is important to reduce the flow rate of the leakage steam (amount of leakage steam) which passes through the clearance.

As a related art, for example, Patent Document 1 proposes a structure in which a plurality of stepped parts are provided in the tip portion of the turbine blade in such a manner that the height thereof becomes gradually higher from the upstream side toward the downstream side in an axial direction; a plurality of seal fins extending toward each of the stepped parts are provided in the casing; and a small clearance is formed between each of the stepped parts and tip of each of the seal fins.

In the turbine, fluid which has flowed from the upstream side into the clearance collides with a step surface of a stepped part, thereby a main vortex is generated on the upstream side of the step surface and a separation vortex is generated on the downstream side (vicinity on the upstream side of the small clearance) of the step surface. Subsequently, the reduction of the leakage flow passing through the small clearance is achieved by the separation vortex generated in the vicinity on the upstream side of the small clearance. In other words, the reduction in the flow rate (amount of leakage steam) of the leakage fluid passing through a clearance between a tip portion of a turbine blade and a casing is achieved.

PRIOR ART DOCUMENT

Patent Document

[Patent Document 1] Japanese Unexamined Patent Application, First Publication No. 2011-080452 (see FIG. 6)

SUMMARY OF INVENTION

Problem to be Solved by the Invention

Meanwhile, in the turbine provided with the plurality of stepped parts and seal fins as described above, the pressure (static pressure) or density of the fluid in the clearance between the tip of the turbine blade and the casing becomes reduced from the upstream side toward the downstream side in the axial direction. Thereby, the flow velocity of the fluid passing through the small clearance on the downstream side is faster than that of the fluid passing through the small clearance on the upstream side.

Therefore, the speed (rotational speed) of the main vortex generated in the stepped part positioned on the downstream side is faster than the speed (rotational speed) of the main vortex generated in the stepped part positioned on the upstream side. Particularly, in the main vortex closer to the downstream side, the flow velocity thereof flowing in the radial direction along the step surface is increased. Thereby, the shape of the separation vortex generated in the stepped part closer to the downstream side is more elongated in the radial direction. If the shape of the separation vortex is elongated, in the separation vortex, the maximum position of a velocity component of the flow flowing in the radial direction from the tip of the seal fin toward the stepped part is moved apart (apart from the small clearance in the radial direction) from the tip of the seal fin toward a base end side thereof. Therefore, the contraction flow effect of reducing the leakage flow passing through the small clearance on the downstream side of the separation vortex becomes reduced. Also, the static pressure reduction effect becomes reduced. As a result, the turbine in the related art has a problem in that the reduction of the amount of leakage steam is limited.

Means for Solving the Problem

An object of the present invention is to provide a turbine capable of further reducing the amount of leakage steam.

According to a first aspect of the present invention, a turbine includes a blade member; and a structural member located close to the blade member such that a clearance is provided between a tip portion of the blade member and the structural member, and fluid passes through the clearance. One of the blade member and the structural member is available to rotate relative to the other. One of the tip of the blade member and part of the structural member opposing the tip portion of the blade member is provided with stepped parts which have step surfaces facing the upstream side in a rotating axial direction of the structural member, and which protrude toward the other of the tip of the blade member and the part of the structural member, the stepped parts are aligned in the rotating axial direction. In the other of the tip of the blade member and the part of the structural member is provided with seal fins which extend toward the circumference surface of the stepped parts and form small clearances between the seal fins and the circumference surfaces corresponding to the stepped parts are provided. A first distance between a first one of the seal fins and the step surface corresponding to the first seal fin in the rotating axial direction is longer than a second distance between a second one of the seal fins adjacent to the first seal fin and the step surface corresponding to the second seal fin, wherein the step surface corresponding to the first seal fin is located at the downstream side with respect to the step surface corresponding to the second seal fin.

In the turbine described above, fluid which has flowed from the upstream side into the clearance collides with the step surface of each stepped part, thereby a main vortex is generated on the upstream side of the step surface, similar to the related art. Furthermore, at a corner section (edge) between the step surface and circumference surface of each stepped part, some flow is separated from the main vortex. Thereby, a separation vortex rotating in a reverse direction to the main vortex is generated on a circumference surface of each stepped part positioned on the downstream side of the step surface thereof. This separation vortex causes a downflow flowing from a tip of the seal fin toward the circumference surface of the stepped part, whereby the separation vortex exhibits a contraction flow effect against the fluid passing through the small clearance between the tip of the seal fin and the stepped part.

Furthermore, the diameter of the separation vortex generated in this way shows a tendency to be proportional to the distance from the step surface of the stepped part to the small clearance on the downstream side thereof. In other words, the shorter the distance is, the smaller the diameter of the separation vortex is. Therefore, according to the turbine described above, even when the speed of flow separated at the corner section between the step surface and the circumference surface of the stepped part on the downstream side is faster than that of flow separated from the main vortex at the corner section between the step surface and the circumference surface of the stepped part on the upstream side, it is possible to reduce the diameter of the separation vortex on the downstream side.

The diameter of the separation vortex on the downstream side is reduced as described above, whereby it is possible to, in the separation vortex on the downstream side, set the maximum position of a velocity component of the flow flowing in the radial direction from the tip of the seal fin toward the downstream side of the stepped part upstream side moved close to the tip of the seal fin. Therefore, it is possible to strengthen the downflow due to the separation vortex on the downstream side. As a result, it is possible to reduce the leakage fluid which passes through the small clearance positioned on the downstream side of the separation vortex. In other words, it is possible to improve the contraction flow effect.

Moreover, the diameter of the separation vortex on the downstream side is reduced, whereby it is possible to reduce static pressure in the separation vortex. Thereby, it is possible to decrease a pressure difference between the upstream side and the downstream side of the small clearance positioned on the downstream side of the separation vortex. In other words, corresponding to the reduction of the pressure difference, it is possible to improve the static pressure reduction effect which causes the leakage flow passing through the small clearance positioned on the downstream side to be reduced.

According to a second aspect of the present invention, in the turbine, it is further preferable that the distance from the seal fins to the stepped parts are set such that one corresponding to the stepped parts positioned as close to the downstream side is shorter than the other.

According to the turbine described above, the separation vortex closer to the downstream side is further reduced in diameter. Thereby, in the small clearance closer to the downstream side, it is possible to effectively improve the contraction flow effect and the static pressure reduction effect due to the separation vortex described above.

Furthermore, according to the turbine described above, an inclined surface inclined from the upstream side toward the downstream side is formed on at least the step surface corresponding to the first seal fin located at the downstream side with respect to the step surface corresponding to the second seal fin, wherein the inclined surface communicates with the circumference surface.

According to the configuration, in the main vortex generated on the upstream side of the step surface in the stepped part on the downstream side, the direction of flow separated at the corner section between the step surface and the circumference surface of the stepped part on the downstream side is inclined, by the inclined surface, to the downstream side in an axial direction with respect to the radial direction. Thereby, it is possible to further reduce the diameter of the separation vortex generated on the circumference surface of the stepped part on the downstream side. Therefore, it is possible to further improve the contraction flow effect and the static pressure reduction effect due to the separation vortex described above.

According to a third aspect of the present invention, in the turbine, inclined surfaces are formed on the step surfaces corresponding to the first and second seal fins, and the inclination angles are set such that a first inclination angle of the step surface corresponding to the first seal fin is smaller than a second inclination angle of the step surface corresponding to the second seal fin.

According to the configuration, it is possible to reduce the diameter of the separation vortices generated on the circumference surfaces of the step surfaces of the two adjacent stepped parts. Furthermore, since the inclination angle of the inclined surface formed on the stepped part on the downstream side is greater than that of the stepped part on the upstream side, it is possible to strengthen a tendency of reducing the diameter of the separation vortex generated on the circumference surface of the stepped part on the downstream side so as to be smaller than that of the stepped part on the upstream side. Therefore, it is possible to further improve the contraction flow effect and the static pressure reduction effect due to the separation vortex described above.

According to the present invention, even in the turbine provided with the plurality of stepped parts and seal fins, it is possible to improve the contraction flow effect and the static pressure reduction effect due to the separation vortex generated in the stepped part positioned on the downstream side. Therefore, the reduction of the amount of leakage steam passing through the clearance between the tip of the blade member (blade) and the structural member can be further improved.

DESCRIPTION OF THE EMBODIMENTS

First Embodiment

Hereinafter, a first embodiment of the present invention will be described referring to FIGS. 1 to 4C.

Figure 1:
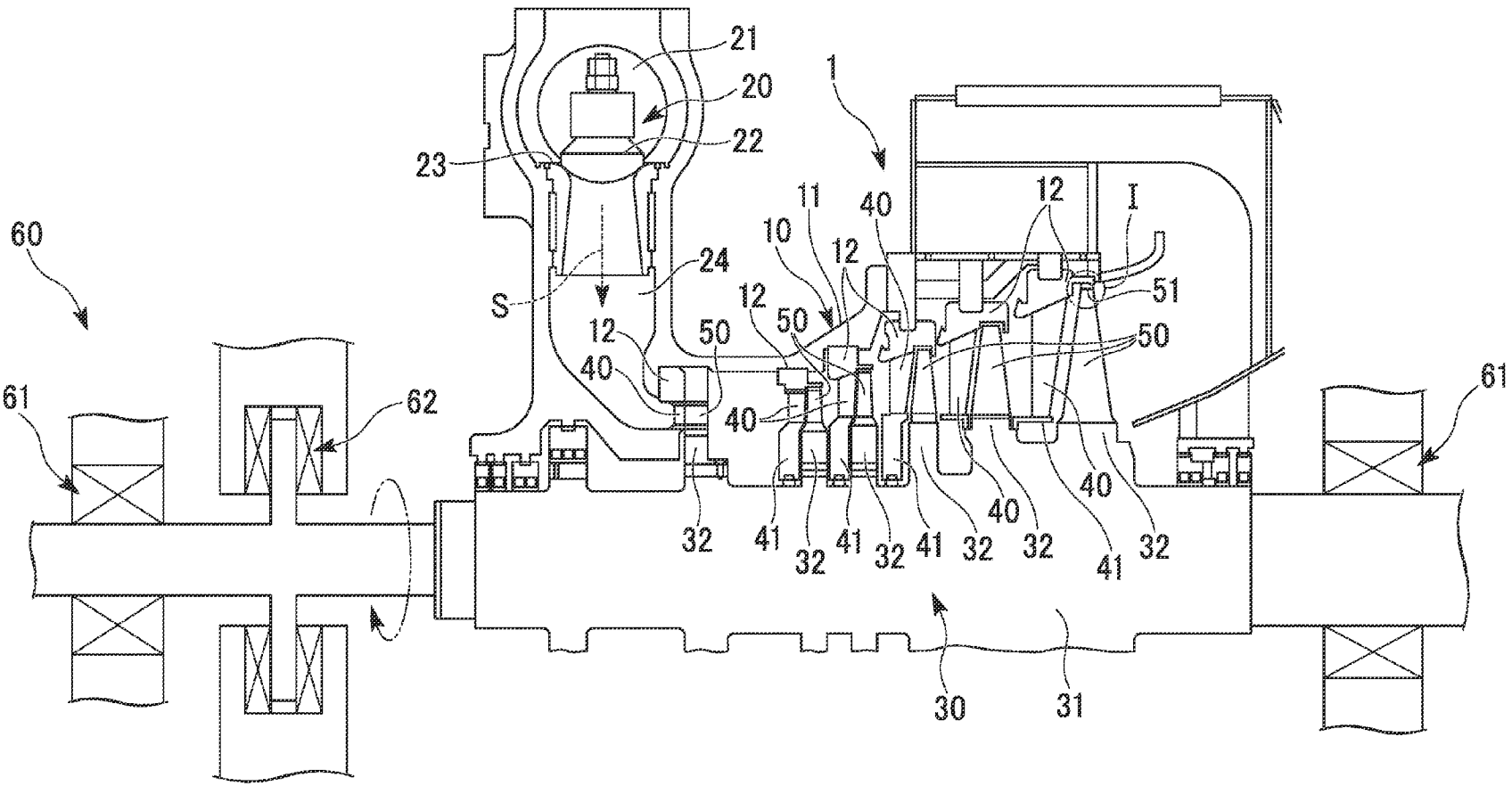
FIG. 1 is a schematic configuration sectional view which shows a steam turbine according to the present invention.

As shown in FIG. 1, a steam turbine 1 according to the embodiment is schematically constituted to include a casing (structural member) 10, a regulating valve 20 to regulate the amount and pressure of steam (fluid) S flowing into the casing 10, a shaft body (rotor) 30 which is provided inside the casing 10 so as to rotate freely and transmits power to a machine such as a generator (not shown), turbine vanes 40 held in the casing 10, turbine blades (blades) 50 provided in the shaft body 30, and a bearing portion 60 which supports the shaft body 30 so as to be axially rotatable.

The casing 10 is formed such that an inner space thereof is sealed hermetically. The casing 10 includes a main body portion 11 which forms a flow channel of the steam S and a ring-shaped diaphragm outer ring 12 which is securely fixed on an inner wall surface of the main body portion 11.

A plurality of the regulating valves 20 are installed inside the main body portion 11 of the casing 10. Each of the regulating valves 20 includes a regulating valve chamber 21 into which steam S flows from a boiler (not shown), a valve body 22, a valve seat 23 and a steam chamber 24. In the regulating valve 20, the valve body 22 thereof moves apart from the valve seat 23, whereby a steam flow channel is opened. Subsequently, the steam S flows into the inner space of the casing 10 via the steam chamber 24.

The shaft body 30 includes a shaft main body 31 and a plurality of disks 32 extending outward in the radial direction from an outer circumference of the shaft main body 31. The shaft body 30 transmits rotational energy to a machine such as a generator (not shown).

Furthermore, the bearing portion 60 includes a journal-bearing part 61 and a thrust-bearing part 62, and supports the shaft body 30 which inserted into the main body portion 11 of the casing 10 so as to be rotatable in the outer side of the main body portion 11.

A large number of the turbine vanes 40 are arranged in a radial pattern so as to surround the shaft body 30. The plurality of turbine vanes 40 which are thus arranged configure groups of annular turbine vanes. Also, the turbine vanes 40 are individually held in the diaphragm outer ring 12. In other words, each of the turbine vanes 40 extends inward in the radial direction from the diaphragm outer ring 12.

Hab shrouds 41 are constituted by the tip of the turbine vanes 40 in the extending direction thereof. The hub shrouds 41 are formed in a ring shape so as to connect the plurality of turbine vanes 40 constituting the same group of annular turbine vanes. The shaft body 30 inserts the hub shrouds 41. Also, the hub shroud 41 is disposed with a clearance kept with respect to the shaft body 30 in the radial direction.

In addition, six groups of annular turbine vanes constituted by the plurality of turbine vanes 40 are formed so as to be spaced apart from each other in the rotating axial direction of the casing 10 and the shaft body 30 (hereinafter, referred to as an axial direction). The groups of annular turbine vanes convert pressure energy of steam S to velocity energy, thereby guiding the steam S to the turbine blades 50 side adjacent to each other on the downstream side in the axial direction.

The turbine blades 50 are securely installed on an outer circumference portion of the disk 32 constituting the shaft body 30 and extend outward in the radial direction from the shaft body 30. On the downstream side of each annular turbine vane group, a large number of the turbine blades 50 are arranged in a radial pattern and configure groups of annular turbines.

One stage is configured with one set of a group of annular turbine vanes and a group of annular turbine blades. That is, the steam turbine 1 is configured in six stages. A tip shroud 51 extending in the circumferential direction is formed on a tip of the turbine blade 50.

Figure 2:
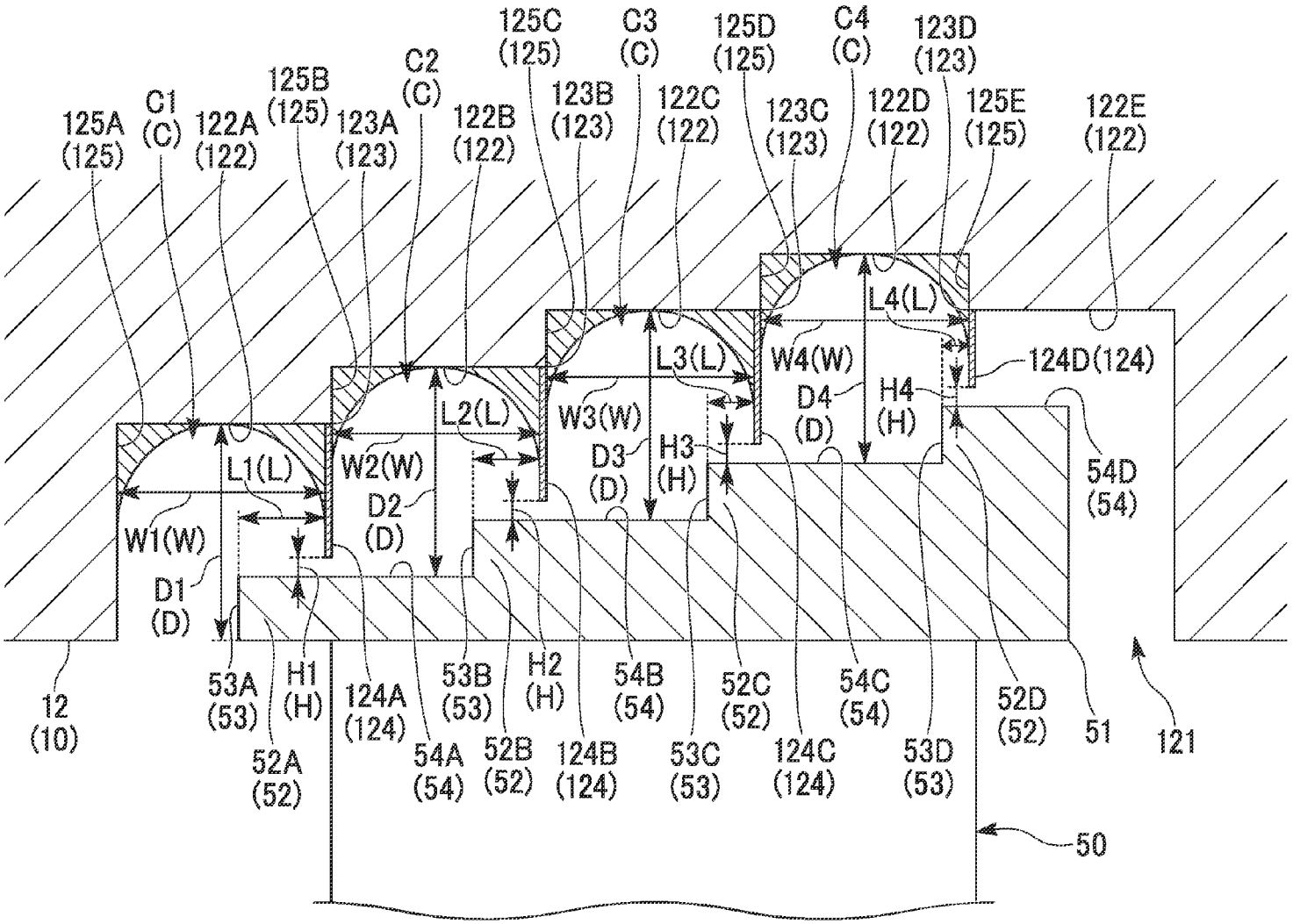
FIG. 2 is a drawing which shows a first embodiment of the present invention and an enlarged sectional view showing a major part I in FIG. 1.

As shown in FIG. 2, the tip shroud 51 formed on the tip of the turbine blade 50 is arranged so as to face the diaphragm outer ring 12 or the casing 10, with a clearance kept in the radial direction therebetween. On the tip shroud 51, four stepped parts 52 (52A to 52D) which respectively have step surfaces 53 (53A to 53D) and protrude toward the diaphragm outer ring 12 are formed along the axial direction of the shaft body 30.

The protrusion heights of the four stepped parts 52A to 52D, which mean the height from the turbine 50 to each of outer circumference surfaces (circumference surfaces) 54A to 54D (54) of the four stepped parts 52A to 52D, are set so as to become gradually higher from the upstream side toward the downstream side in the shaft direction. Therefore, the step surface 53 of each of the stepped parts 52 is formed to face the upstream side in the axial direction. Furthermore, in the embodiment, the step surface 53 of each of the stepped parts 52 is parallel in the radial direction. Also, the four step surfaces 53A to 53D are all equal in height. Still further, in the embodiment, the outer circumference surface 54 of each of the stepped parts 52 is parallel in the axial direction.

On the other hand, in the diaphragm outer ring 12, an annular groove 121 extending in a circumferential direction is formed on the region corresponding to the tip shroud 51. In the embodiment, the annular groove 121 is formed on an inner circumference surface of the diaphragm outer ring 12 so as to be recessed outward in the radial direction. The tip shroud 51 is disposed so as to be housed in the annular groove 121.

Also, in a bottom portion of the annular groove 121 facing inward in the radial direction, five annular recessed portions 122 (122A to 122E) are formed along the axial direction so as to face the four stepped parts 52A to 52D. In addition, from the upstream side toward the downstream side, the diameters of the four annular recessed portions 122A to 122D positioned on the upstream side in the axial direction are gradually widened by means of the steps. On the other hand, the diameter of the annular recessed portion 122E positioned on the most downstream side is smaller than that of the fourth-stage annular recessed portion 122D adjacent in the upstream side.

Furthermore, seal fins 124 (124A to 124D) extending inward in the radial direction toward the tip shroud 51 are respectively provided in end edge portions (edge portions) 123 (123A to 123D) which are positioned at the boundary between two annular recessed portions 122 and 122 adjacent in the axial direction. The position of the end edge portions 123 and the seal fins 124 is set so as to face the outer circumference surface 54 of the each stepped parts 52. More specifically, the four seal fins 124A to 124D are arranged spaced apart from each other in the axial direction, and provided so as to correspond to the four stepped parts 52A to 52D on a one-to-one basis. Also, in the embodiment, the four seal fins 124A to 124D are arranged at the same intervals in the axial direction.

In addition, the three seal fins 124A to 124C positioned on the upstream side are disposed such that a surface of each seal fin 124 facing downstream side and inner surfaces 125 (125B to 125D) on the upstream side of the annular recessed portions 122 (122B to 122D) which are respectively positioned on the downstream side of the seal fins 124 form the same plane. On the other hand, the seal fin 124D (fourth seal fin 124D) positioned on the most downstream side is disposed such that a surface of the seal fin 124D facing upstream side and an inner surface 125E on the downstream side of the annular recessed portions 122D which is positioned on the upstream side of the fourth seal fin 124D form the same plane.

Still further, each of small clearances H (H1 to H4) is formed between the outer circumference surface 54 of each stepped part 52 and the tip of each seal fin 124, in the radial direction. Each of the small clearances H is set to the minimum value within a safety range in which the casing 10 is not in contact with the turbine blades 50, by taking into consideration on a thermal expansion amount of the casing 10 or the turbine blade 50, a centrifugal expansion amount of the turbine blade 50, or the like. In the embodiment, the four small clearances H1 to H4 are all equal in size.

Furthermore, in the embodiment, along the axial direction, a distance L (length L of the outer circumference surface 54 of each stepped part 52, namely a distance from each small clearance H to the step surface 53 on the upstream side) from each small clearance H (each seal fin 124) to the step surface 53 of the stepped part 52 positioned on the downstream side is set to the smaller value in the stepped part 52 positioned closer to the downstream side, compared to the other ones.

That is, a relationship between a distance L1 (first distance L1) from a first small clearance H1 on the outer circumference surface 54A of the first-stage stepped part 52A positioned on the most upstream side to the step surface 53A of the first-stage stepped part 52A, a distance L2 (second distance L2) from a second small clearance H2 on the outer circumference surface 54B of the second-stage stepped part 52B to the step surface 53B of the second-stage stepped part 52B, a distance L3 (third distance L3) from a third small clearance H3 on the outer circumference surface 54C of the third-stage stepped part 52C to the step surface 53C of the third-stage stepped part 52C, and a distance L4 (fourth distance L4) from a fourth small clearance H4 on the outer circumference surface 54D of the fourth-stage stepped part 52D to the step surface 53D of the fourth-stage stepped part 52D in the axial direction satisfies the following Formula (1).

$$L1>L2>L3>L4 \quad (1)$$

In other words, in the embodiment, an aspect ratio L/H of the distance L to the small clearance H is set such that the aspect ratio L/H of the stepped part 52 positioned closer to the downstream side is smaller than the other one.

In addition, the seal fins 124 are provided as described above, whereby four cavities C (C1 to C4) are formed between the tip shrouds 51 and the diaphragm outer ring 12 so as to be arranged in the axial direction. Each of the cavities C is formed between the seal fin 124 corresponding to each stepped part 52 and a partition wall opposing the seal fin 124 on the upstream side in the axial direction.

More specifically, a first cavity C1 formed on the most upstream side in the axial direction is formed between the first seal fin 124A corresponding to the first-stage stepped part 52A and the inner surface 125A on the upstream side of the first-stage annular recessed portion 122A which opposes the first seal fin 124A on the upstream side in the axial direction.

Furthermore, a second cavity C2 adjacent the first cavity C1 on the downstream side is formed between the second seal fin 124B corresponding to the second-stage stepped part 52B, and the first seal fin 124A opposing the second seal fin 124B on the upstream side in the axial direction and the inner surface 125B on the upstream side of the second-stage annular recessed portion 122B.

Still further, similar to the second cavity C2, a third cavity C3 adjacent the second cavity C2 on the downstream side is formed between the third seal fin 124C corresponding to the third-stage stepped part 52C, and the second seal fin 124B and the inner surface 125C on the upstream side of the third-stage annular recessed portion 122C.

In addition, a fourth cavity C4 adjacent the third cavity C3 is formed between the third seal fin 124D corresponding to the fourth-stage stepped part 52D and the inner surface 125E on the downstream side of the fourth-stage annular recessed portion 122D, and the third seal fin 124C opposing the seal fin 124D on the upstream side in the axial direction and the inner surface 125D on the upstream side of the fourth-stage annular recessed portion 122D.

Moreover, according to the embodiment, in each of the cavities of C, a corner portion between a bottom surface (surface facing inward in the radial direction) of each annular recessed portion 122 and the inner surface 125 of each annular recessed portion 122 or each seal fin 124 is roundedly formed. Thereby, the bottom surface of each annular recessed portion 122 and the inner surface 125 of the annular recessed portion 122 are smoothly continued. Also, the bottom surface of each annular recessed portion 122 and the surface of the seal fin 124 on the upstream or downstream side in the axial direction are smoothly continued. Since the corner portion of the cavity C is roundedly formed as described above, the outline thereof becomes close to the shape of a main vortex MV generated in the cavity C, as described below. Therefore, it is possible to suppress energy losses of the main vortex MV in the corner portion of the cavity C (see FIG. 3).

Furthermore, in the embodiment, each part of the four cavities C1 to C4 is set to the same size, except the distance L described above. For example, axial directional distances (axial directional widths W (W1 to W4) of the cavities C) from the seal fins 124 to the partition wall opposing the seal fins 124 on the upstream side in the axial direction, or radial directional distances (radial directional distances D (D1 to D4) of the cavities) from the bottom surfaces of the annular recessed portions 122 to lower ends (radial directional inner ends) of the step surfaces 53 of the stepped parts 52 are set to the same sizes in the four cavities C1 to C4. In addition, it is preferable that, a ratio D/W (aspect ratio D/W in the cavity) of the radial directional distance D to the axial directional width W in each cavity C is approximately set to 1.0 such that the size of a separation vortex SV generated in the cavity C is smaller than that of the main vortex MV generated in the same cavity C, as described below (see FIG. 3).

Next, the operation of the steam turbine 1 configured as above will be described.

First, when the regulating valve 20 (see FIG. 1) is in an opened state, steam S flows from a boiler (not shown) into the inner space of the casing 10.

Figure 3:
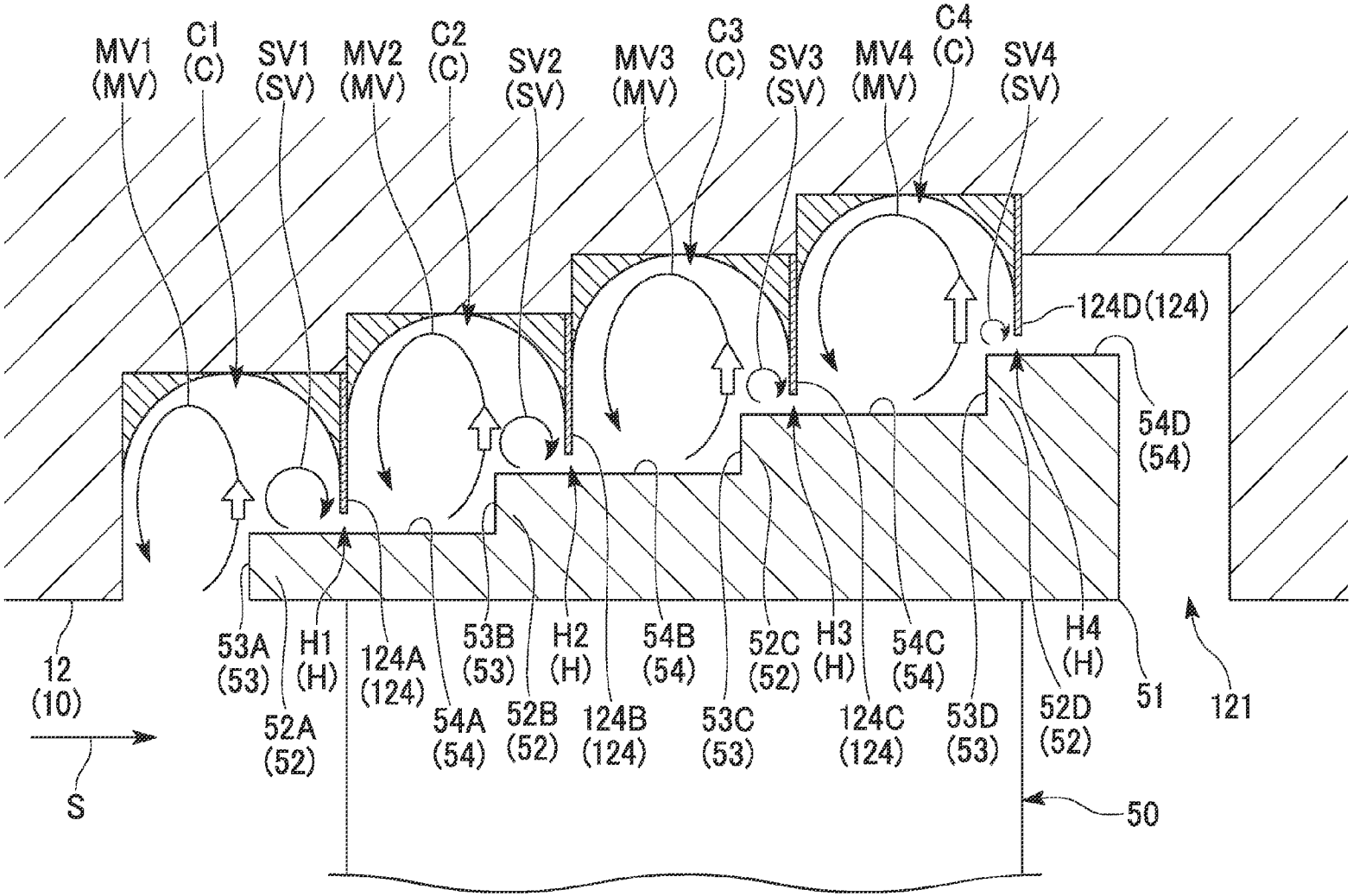
FIG. 3 is a drawing which describes actions of the steam turbine according to the first embodiment of the present invention.

The steam S flowing into the inner space of the casing 10 sequentially passes the group of annular turbine vanes and the group of annular turbine blades in each stage. At this time, turbine vanes 40 convert pressure energy to velocity energy, and then almost all of the steam S which has passed the turbine vanes 40 flows into the turbine blades 50 constituting the same stage. Subsequently, the turbine blades 50 convert the velocity energy of the steam S to rotational energy, whereby torque is imparted to the shaft body 30. Meanwhile, some of the steam S (for example, several percent) flows from the turbine vanes 40 into the annular groove 121 (clearance between the tip shroud 51 of the turbine blade 50 and the diaphragm outer ring 12 of the casing 10) as shown in FIG. 3. That is, some of the steam S becomes leakage steam.

In this case, the steam S flowing into the annular groove 121 collides with the step surface 53A of the first-stage stepped part 52A as soon as flowing into the first cavity C1, whereby the steam S flows so as to return to the upstream side. Thereby, a main vortex MV1 rotating counterclockwise (first rotational direction) is generated in the first cavity C1.

At this time, particularly at the corner section (edge) between the step surface 53A and the outer circumference surface 54A in the first-stage stepped part 52A, some flow is separated from the main vortex MV1. Therefore, a separation vortex SV1 rotating clockwise (second rotational direction) which is a reverse direction to the main vortex MV1 is generated on the outer circumference surface 54A of the first-stage stepped part 52A.

The separation vortex SV1 is positioned in the vicinity on the upstream side of the first small clearance H1 between the first-stage stepped part 52A and the first seal fin 124A. Particularly, in the separation vortex SV1, a downflow flowing inward in the radial direction is generated at the position immediately before the first step surface H1. Thereby, the separation vortex SV1 exhibits a contraction flow effect which reduces the leakage flow flowing from the first cavity C1 into the second cavity C2 on the downstream side through the first small clearance H.

Subsequently, when the steam S flows from the first cavity C1 into the second cavity C2 through the first step surface H1, the steam S collides with the step surface 53B of the second-stage stepped part 52B, whereby flowing so as to return to the upstream side. Thereby, a main vortex MV2 rotating in the first rotational direction, namely the same direction as the main vortex MV1 generated in the first cavity C1, is generated in the second cavity C2.

Also, at the corner section between the step surface 53B and the outer circumference surface 54B in the second-stage stepped part 52B, some flow is separated from the main vortex MV2. Therefore, a separation vortex SV2 rotating in the reverse direction to the main vortex MV2 (second rotational direction) is generated on the outer circumference surface MB of the second-stage stepped part 52B.

Subsequently, when the steam S passes through the second small clearance H2 and flows into the third cavity C3, similar to the case at the first and second cavities C1 and C2, the steam S collides with the step surface 53C of the third-stage stepped part 52C, whereby flowing so as to return to the upstream side. Thereby, a main vortex MV3 rotating in the first rotational direction is generated in the third cavity C3. Also, a separation vortex SV3 rotating in the second rotational direction is generated on the outer circumference surface 54C of the third stepped part 52C.

In the same way as above, when the steam S passes through the third small clearance H3 and flows into the fourth cavity C4, the steam S collides with the step surface 53D of the fourth-stage stepped part 52D, whereby a main vortex MV4 rotating in the first rotational direction is generated in the fourth cavity C4. Also, a separation vortex SV4 rotating in the second rotational direction is generated on the outer circumference surface 54D of the fourth stepped part 52D.

In this case, similar to the related art, the pressure (static pressure) or density of the steam S in the clearance between the tip shroud 51 and the diaphragm outer ring 112 becomes reduced from the upstream side toward the downstream side in the axial direction. Therefore, as approaching closer to the downstream side, the flow velocity of the steam S flowing from the each of the small clearances H (H1 to H3) into the each of the cavities C (C2 to C4) on the downstream side, or the speed (rotational speed) of the main vortices MV (MV2 to MV4) generated in the cavities C (C2 to C4) on the downstream side is increased. Particularly, in the main vortices MV (MV2 to MV4) closer to the downstream side, the flow velocity flowing outward in the radial direction along the step surface 53 is increased. Therefore, there is a possibility that the diameters of the separation vortices SV (separation vortices SV2 to SV4, for example) generated on the outer circumference surface 54 of each stepped part 52 on the downstream side may be greater than that of the separation vortex SV (separation vortex SV1, for example) generated on the outer circumference surface 54 of the stepped part 52 on the upstream side.

However, in the embodiment, along the axial direction, the distances L (L1 to L4) from the small clearances H to the step surfaces 53 on the upstream side are set so as to satisfy Formula (1) described above. Therefore, it is possible to reduce the diameters of the separation vortices SV2 to SV4 on the downstream side, because the smaller the distance L (aspect ratio L/H) is, the smaller the diameter of the separation vortex SV produced on the outer circumference surface 54 of the stepped part 52 is.

Therefore, in the steam turbine 1 according to the embodiment, it is possible to reduce the diameters of the separation vortices SV2 to SV4 on the downstream side. Thereby, in the separation vortices SV2 to SV4 on the downstream side, the maximum position of a velocity component of the flow which flows inward in the radial direction from the tip side of each of the seal fins 124B to 124D toward each of the outer circumference surfaces 54B to 54D of the stepped parts 52B to 52D can be moved closer to the tip of each of the seal fins 124B to 124D. Consequently, it is possible to, in each of the separation vortices SV2 to SV4 on the downstream side, strengthen the downflow generated immediately before each of the small clearances H2 to H4. As a result, it is possible to reduce the leakage flow of the steam S which passes through each of the small clearances H2 to H4. In other words, it is possible to improve the contraction flow effect.

Furthermore, since the diameters of the separation vortices SV2 to SV4 on the downstream side are reduced, it is possible to reduce the static pressures in the separation vortices SV2 to SV4. Thereby, it is possible to reduce the pressure difference between the upstream side and the downstream side of the small clearances H2 to H4 positioned on the downstream side of the separation vortices SV2 to SV4. For example, the diameter of the separation vortex SV3 in the third cavity C3 is reduced, whereby the static pressure difference between the static pressure in the third cavity C3 on the upstream side and the static pressure in the fourth cavity C4 on the downstream side can be reduced. Therefore, corresponding to the reduction of the pressure difference, it is possible to improve the static pressure reduction effect which causes the leakage flow passing through the small clearances H2 to H4 positioned on the downstream side to be reduced.

Particularly, in the embodiment, the distances L (L1 to L4) are set so as to satisfy Formula (1) described above. Therefore, the separation vortex SV closer to the downstream side is further reduced in diameter. As a result, in the small clearance H closer to the downstream side, the contraction flow effect and the static pressure reduction effect due to the separation vortex SV described above can be more effectively improved.

Consequently, according to the steam turbine 1 of the embodiment, it is possible to reduce the amount of leakage steam passing through the clearance between the tip shroud 51 of the turbine blade 50 and the diaphragm outer ring 12 of the casing 10.

Figure 4A:
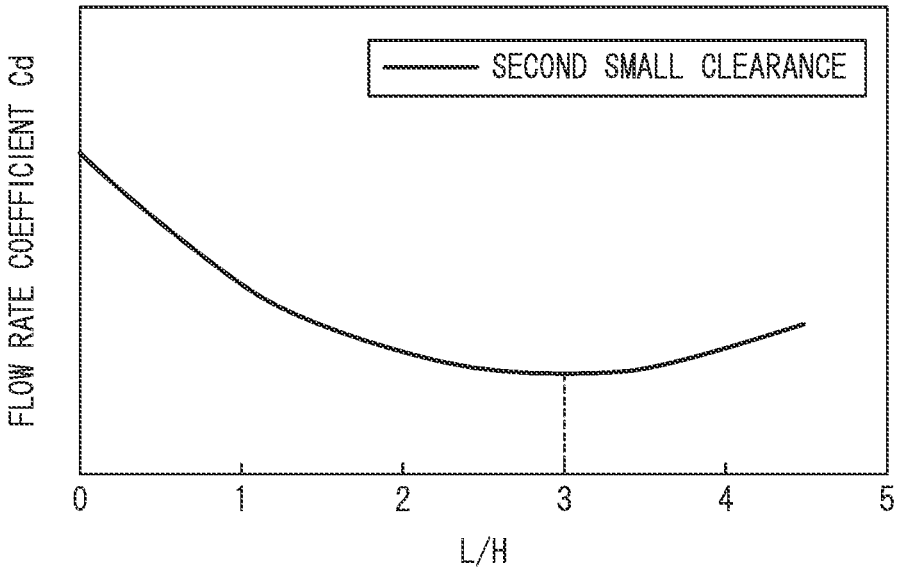
FIG. 4A is a graph which shows a relationship between an aspect ratio L/H of a distance L to a small clearance H and a flow rate coefficient Cd of steam passing through the small clearance H in the configuration shown in FIG. 2.
Figure 4B:
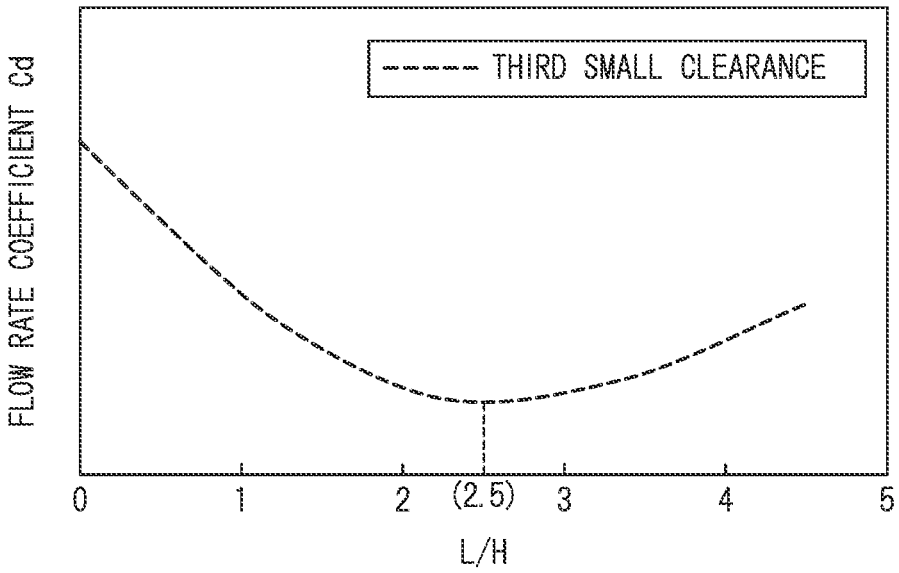
FIG. 4B is a graph which shows a relationship between an aspect ratio L/H of a distance L to a small clearance H and a flow rate coefficient Cd of steam passing through the small clearance H in the configuration shown in FIG. 2.
Figure 4C:
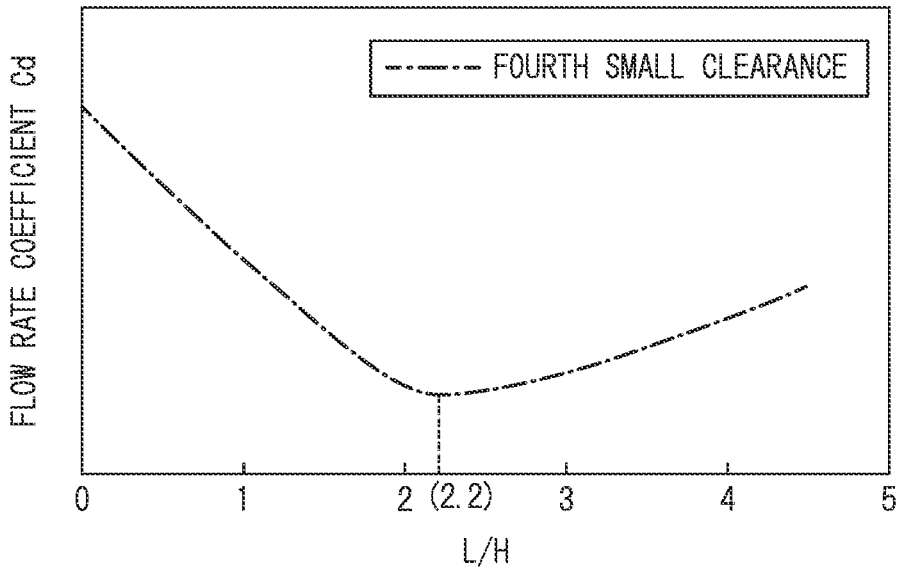
FIG. 4C is a graph which shows a relationship between an aspect ratio L/H of a distance L to a small clearance H and a flow rate coefficient Cd of steam passing through the small clearance H in the configuration shown in FIG. 2.

Furthermore, as shown in FIGS. 4A to 4C, the effects described above are confirmed by the results of simulations conducted by the inventor.

Each of the graphs shown in FIGS. 4A to 4C shows the result of the simulation which was run with regard to a relationship between, in the same stepped part 52, the aspect ratio L/H and the flow rate coefficient Cd of the steam S passing through the small clearance H, with respect to the second small clearance H2 (second-stage stepped part 52B), the third small clearance H3 (third-stage stepped part 52C) and the fourth small clearance H4 (fourth-stage stepped part 52D). In this graph, the smaller flow rate coefficient Cd, the smaller the flow rate of the steam S passing through the small clearance H.

According to the graph, in each of the small clearances H2 to H4, the optimal value of the aspect ratio L/H to minimize the flow rate coefficient Cd is present. Specifically, the optimal value of the aspect ratio L/H in the second small clearance H2 is 3.0 (see FIG. 4A), and the optimal value of the aspect ratio L/H in the third small clearance H3 is 2.5 (see FIG. 4B). Also, the optimal value of the aspect ratio L/H in the fourth small clearance H4 is 2.2 (see FIG. 4C). That is, the small clearance H positioned closer to the downward is small in the optimal value of the aspect ratio L/H to minimize the flow rate coefficient Cd. In other words, the optimal distance L thereof becomes shorter.

In addition, in the first embodiment described above, the five annular recessed portions 122A to 122E (particularly, the four annular recessed portions 122A to 122D on the upstream side) corresponding to the four stepped parts 52A to 52D are formed on the diaphragm outer ring 12 such that the sizes of the four cavities C do not become smaller from the upstream side to the downstream side. Therefore, even if the distance L of the cavity C (third cavity C3 or fourth cavity C4, for example), especially on the downstream side, is not set finely and precisely, it is possible to simply set the size of the separation vortex SV generated in the cavity C to be smaller than the size of the main vortex MV generated in the same cavity C.

Furthermore, in the first embodiment, the step surface 53 of each of the stepped parts 52 is parallel in the radial direction. That is, the step surfaces 53 of the first embodiment are not inclined, as being inclined in the case of a second embodiment. Therefore, it is possible to simply reduce the size of the tip shroud 51 in the axial direction.

Second Embodiment

Next, the second embodiment of the present invention will be described referring to FIGS. 5 and 6.

Upon comparison with the steam turbine 1 of the first embodiment, the second embodiment has a difference in that only the shape of each stepped part 52 is different from that of the first embodiment, and other configurations are the same as those in the first embodiment. In the second embodiment, the same reference numerals and signs are given to the same constituent elements as those of the first element, and the description thereof will be omitted.

Figure 5:
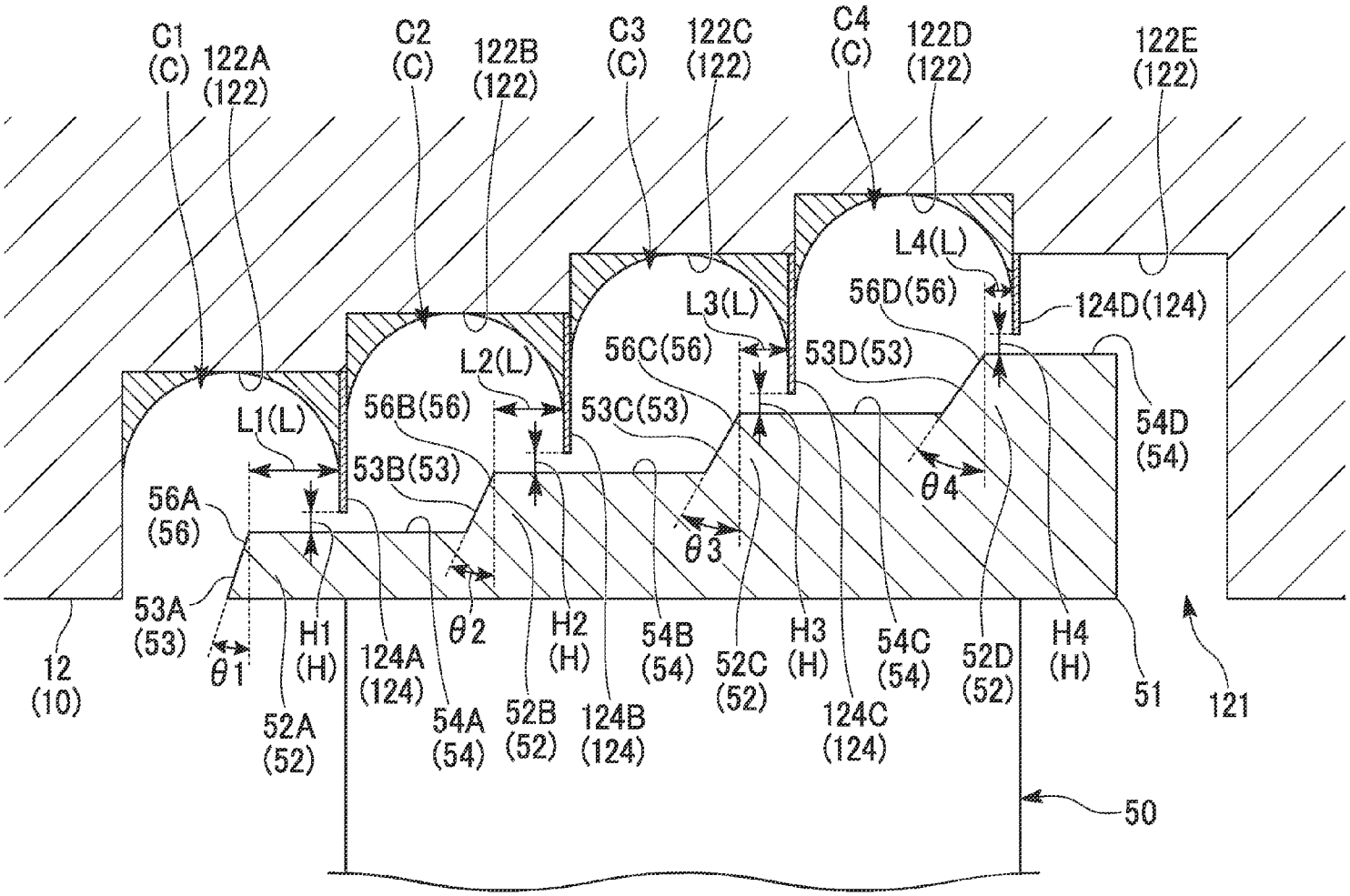
FIG. 5 is a drawing which shows a second embodiment of the present invention and an enlarged sectional view showing the major part I in FIG. 1.

As shown in FIG. 5, inclined surfaces 56 (56A to 56D) inclined from the upstream side to the downstream side are respectively formed on the step surfaces 53 (53A to 53D) of the stepped parts 52 (52A to 52D) so as to be continuous with each of the outer circumference surfaces 54 (54A to 54D) of the same stepped parts 52.

Furthermore, in the four inclined surfaces 56A to 56D, inclination angles θ1 to θ4 with respect to the radial direction become greater from the upstream side toward the downstream side.

That is, in the four stepped parts 52 (52A to 52D), the inclination angle θ1 of the inclined surface 56A formed on the step surface 53A of the first-stage stepped part 52A positioned on the most upstream side, the inclination angle θ2 of the inclined surface 56B formed on the step surface 53B of the second-stage stepped part 52B, the inclination angle θ3 of the inclined surface 56C formed on the step surface 53C of the third-stage stepped part 52C, and the inclination angle θ4 of the inclined surface 56D formed on the step surface 53D of the fourth-stage stepped part 52D satisfy the following Formula (2).

$$\theta 1<\theta 2<\theta 3<\theta 4 \quad (2)$$

Furthermore, in the example shown in the drawings, each of the inclined surfaces 56 is formed on each of the step surfaces 53. However, without being limited thereto, the inclined surface may be formed, for example, only on an upper end part (outward end part in the radial direction) of the step surface 53 continuous with the outer circumference surface 54 on the same stepped part 52, and a lower end part (inward end part in the radial direction) of the step surface 53 may be parallel to the radial direction.

Figure 6:
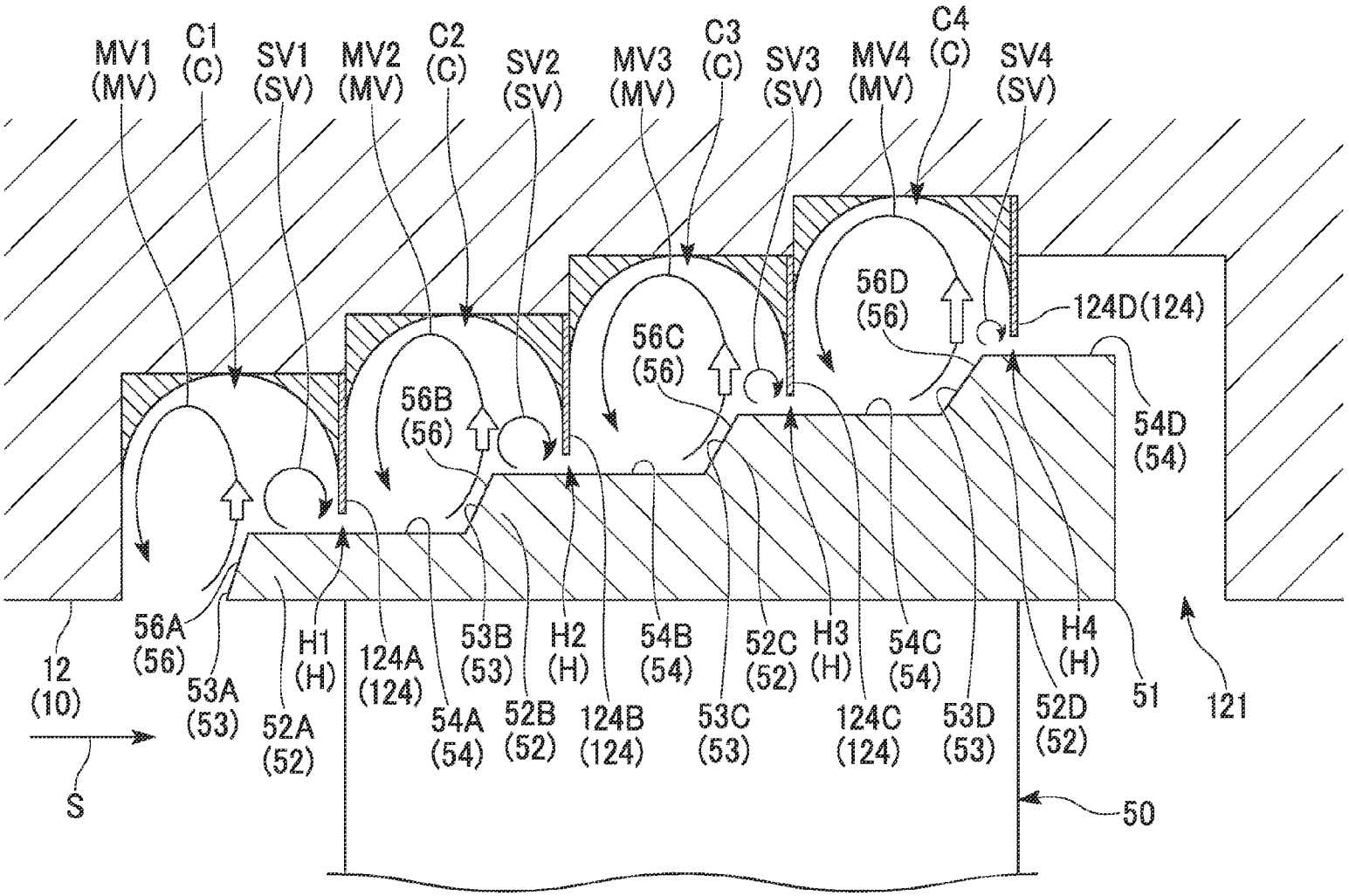
FIG. 6 is a drawing which describes actions of the steam turbine according to the second embodiment of the present invention.

In the steam turbine of the second embodiment configured as above, as shown in FIG. 6, when the steam S flows into the annular groove 121, each of the main vortices MV (MV1 to MV4) rotating in the first rotational direction and each of the separation vortices SV (SV1 to SV4) rotating in the second rotational direction are generated in each of the cavities C (C1 to C4), similar to the case of the first embodiment.

Therefore, according to the steam turbine 1 of the second embodiment, it is possible to achieve the same effect as the first embodiment.

Furthermore, in the second embodiment, the inclined surface 56 is formed on the step surface 53 of each stepped part 52. Thereby, in the main vortex MV generated in each cavity C, the direction of flow separated at the corner section between the step surface 53 and the outer circumference surface 54 of each stepped part 52 is inclined, by the inclined surface 56, to the downstream side in the axial direction with respect to the radial direction. Consequently, it is possible to reduce the diameter of the separation vortex SV generated on the outer circumference surface 54 of each stepped part 52.

Furthermore, in the embodiment, the inclination angles θ2 to θ4 of the inclined surfaces 56B to 56D formed on the stepped parts 52B to 52D on the downstream side are greater than the inclination angle θ1 of the inclined surface 56A formed on the stepped part 52A on the upstream side. Therefore, it is possible to strengthen the tendency to reduce the diameters of the separation vortices SV2 to SV4 generated on the outer circumference surfaces 54B to 54D of the stepped parts 52B to 52D on the downstream side smaller than the diameter of the separation vortex SV1 generated on the outer circumference surface 54A of the stepped part 52A on the upstream side.

Consequently, it is possible to improve the contraction flow effect and the static pressure reduction effect due to the separation vortices SV2 to SV4 on the downstream side.

Particularly, in the second embodiment, since the inclination angles θ1 to θ4 are set to satisfy Formula (2) described above, the separation vortex SV closer to the downstream side is further reduced in diameter. As a result, in the small clearance H closer to the downstream side, the contraction flow effect and the static pressure reduction effect due to the separation vortex SV described above are much more effectively improved.

Consequently, according to the steam turbine 1 of the second embodiment, it is possible to further reduce the amount of leakage steam passing through the clearance between the tip shroud 51 of the turbine blade 50 and the diaphragm outer ring 12 of the casing 10 than in the case of the first embodiment.

In addition, in the second embodiment, each of the inclined surfaces 56 is formed in a linear cross-section shape having a constant inclination angle. However, without being limited thereto, each of the inclined surfaces 56 may be formed in a circular cross-section shape of which the inclination angle with respect to the radial direction is changed as approaching closer to the outer circumference surface 54 of each stepped part 52, for example. Also, each of the inclined surfaces 56 may be formed in the appropriately combined shape having the linear cross-section shaped part and the circular cross-section shaped part.

As described above, if a part or the entire inclined surface 56 is formed in a circular cross-section shape, the flow of the main vortex MV along the step surface 53 becomes smooth. Therefore, it is possible to suppress energy losses of the main vortex MV.

Furthermore, in such a configuration where the inclined surface 56 has a circular cross-section shaped part, when the circular cross-section shaped part is continuous with the outer circumference surface 54, a relative angle between the radial direction and the circular cross-section shaped part in the corner section between the circular cross-section shaped part and the outer circumference surface 54 may be set as an inclination angle of the inclined surface 56 with respect to the radial direction. Also, when the linear cross-section shaped part of the inclined surface 56 is continuous with the outer circumference surface 54, similar to the case of the second embodiment described above, a relative angle between the radial direction and the linear cross-section shaped part may be set as an inclination angle of the inclined surface 56 with respect to the radial direction.

In addition, when a part or the entire inclined surface 56 is formed in a circular cross-section shape, the circular cross-section shape of which the inclination angle with respect to the radial direction is gradually decreased is preferable to the circular cross-section shape of which the inclination angle is gradually increased, from the standpoint of preventing the fluid flowing along the inclined surface 56.

Still further, the inclination angles of the four inclined surfaces 56A to 56D are not limited to the values of the second embodiment which satisfy Formula (2). In at least two adjacent stepped parts 52 and 52, the inclination angles of the inclined surfaces 56 thereof may be set so that one of the stepped part 52 on the upstream side is greater than the other one of the stepped part 52 on the downstream side.

For example, when the inclination angle θ3 (third inclination angle θ3) of the inclined surface 56C of the third-stage stepped part 52C is set to be smaller than the inclination angle θ2 (second inclination angle θ2) of the inclined surface 56B of the second-stage stepped part 52B, the second inclination angle θ2 may be set to be equal to or more than the first inclination angle θ1 of the inclined surface 56A of the first-stage stepped part 52A, or the fourth inclination angle θ4 of the inclined surface 56D of the fourth-stage stepped part 52D may be set to be equal to or more than the third inclination angle θ3.

Furthermore, in the second embodiment, the inclined surfaces 56 are formed on all of the step surfaces 53. However, in two adjacent stepped parts 52 and 52, the inclined surface 56 may be formed at least on the step surface 53 of the stepped part 52 on the downstream side.

For example, the inclined surface 56C may be only formed on the step surface 53C of the third-stage stepped part 52C, and the inclined surfaces 56C may be not formed on the step surfaces 53A, 53B and 53D of the other stepped parts 52A, 52B and 52D. Also, for example, the inclined surfaces 56A and 56C may be only formed on the step surfaces 53A and 53C of the first-stage and third-stage stepped parts 52A and 52C, and the inclined surfaces 56B and 56D may be not formed on the step surfaces 53B and 53D of the second-stage and fourth-stage stepped parts 52B and 52D.

Thus, the details of the present invention are described, the present invention is not limited to the embodiments described above, and various modifications can be added to the embodiments without departing from the scope of the technical idea of the invention.

For example, it is preferable that the sizes of the four small clearances H1 to H4 are set to the same minimal values as the embodiments described above, but it is also possible to be set to sizes different from each other. Moreover, in this case, it is preferable that the four distances L1 to L4 are set such that the aspect ratios L/H of the distances L to the small clearances H become smaller from the upstream side to the downstream side.

Still further, the distances L from each of the small clearances H (each seal fin 124) to the step surface 53 of the stepped part 52 positioned on the upstream side thereof along the axial direction are not limited to the values satisfying Formula I described above. In at least two adjacent stepped parts 52 and 52, the distances L may be set so that one of the stepped part 52 on the downstream side is shorter than the other one of the stepped part 52 on the upstream side.

Specifically, for example, when the third distance L3 from the third small clearance H3 to the step surface 53C of the third-stage stepped part 52C is set to be shorter than the second distance L2 from the second small clearance H2 to the step surface 53B of the second-stage stepped part 52B, the second distance L2 may be set to be equal to or more than the first distance L1 from the first small clearance H1 to the step surface 53A of the first-stage stepped part 52A, or the fourth distance L4 from the fourth small clearance H4 to the step surface 53D of the fourth-stage stepped part 52D may be set to be equal to or more than the third distance L3.

Furthermore, in the embodiments, the heights of the four step surfaces 53A to 53D are set to the same, but it is also possible for them to be set differently.

Also, in the embodiments, the four seal fins 124A to 124D are arranged at the same intervals in the axial direction, but it is also possible for them to be arranged not at the same intervals.

Still further, in the embodiments, a part of the corner portion of each cavity C is roundedly formed. However, for example, all of the corner portion may be formed roundedly, or the corner portion may be not formed roundedly.

In addition, in the embodiments, the four annular recessed portion 122A to 122D of which the diameters are gradually widened by means of the steps, and the fifth-stage annular recessed portion 122E of which the diameter is smaller than that of the fourth-stage annular recessed portion 122D are respectively formed in the bottom portions of the annular grooves 121. However, without being limited thereto, it is also possible to set the diameters of the bottom portions of the annular grooves 121 to approximately the same value, for example. In this case, the sizes of the four cavities C1 to C4 become smaller from the upstream side toward downstream side.

Also, in the embodiments, each part of the four cavities C1 to C4 is set to the same size, except the distance L, but it is also possible to be set not to the same values.

Still further, in the embodiments, the four stepped parts 52 are formed on the tip shroud 51, whereby the four cavities C are formed corresponding thereto. However, at least a plurality of the stepped parts 52 and the cavities C corresponding thereto may be provided, such as two, three or five or more.

Furthermore, the seal fins 124 and the annular recessed portions 122 are formed on the diaphragm outer ring 12 of the casing 10, but it is also possible for them to not be formed on the diaphragm outer ring 12 but directly on the main body portion 11 of the casing 10, for example.

Still further, in the embodiment, the plurality of stepped parts 52 are provided on the tip shroud 51, and the seal fins 124 are provided on the casing 10. However, it is also possible to provide the plurality of stepped parts 52 on the casing 10 and to provide the seal fins 124 on the tip shroud 51, for example.

Furthermore, the configuration which realizes the contraction flow effect and the static pressure reduction effect as in the embodiments described above is not limited to the configuration of being formed in the clearance between the tip shroud 51 constituting the tip of the turbine blade 50 and the casing 10, and may be formed in the clearance between the hub shroud 41 constituting the tip of the turbine vane 40 and the shaft body 30. In other words, the turbine vane 40 may be used as a "blade member (blade)" of the present invention, and the shaft body 30 may be used as a "structural member" of the present invention. In this case, it is possible to achieve the same effects as the embodiments described above.

In the embodiments described above, the present invention has been applied to a condensing steam turbine. However, the present invention may be applicable to other types of steam turbines, for example, a two-stage extraction turbine, an extraction turbine, and a mixed pressure turbine.

Furthermore, in the embodiments described above, the present invention is applied to a steam turbine. However, the present invention is also applicable to a gas turbine. Still further, the present invention is applicable to all machines with rotating blades.

Hereinbefore, a description has been so far made of preferred examples of the present invention. However, without being limited thereto, the present invention may be subjected to addition, omission, replacement and other modifications of the configuration within a scope not departing from the gist of the present invention. The present invention is not limited to the description described above, but is only limited by the scope of the attached claims.

DESCRIPTION OF REFERENCE NUMERALS

1: steam turbine (turbine), 10: casing (structural member), 11: main body portion, 12: diaphragm outer ring, 30: shaft body, 40: turbine vane, 41: hub shroud, 50: turbine blade (blade), 51: tip shroud, 52, 52A, 52B, 52C, 52D: stepped part, 53, 53A, 53B, 53C, 53D: step surface, 54, 54A, 54B, 54C, 54D: outer circumference surface, 56, 56A, 56B, 56C, 56D: inclined surface, 121: annular groove, 124, 124A, 124B, 124C, 124D: seal fin, C, C1, C2, C3, C4: cavity, H, H1, H2, H3, H4: small clearance, L, L1, L2, L3, L4: distance, S: steam (fluid), θ1, θ2, θ3, θ4: inclination angle

The invention claimed is:

1. A turbine comprising:

a blade member; and a structural member located close to the blade member such that a clearance is provided between a tip portion of the blade member and the structural member, and fluid passes through the clearance, wherein the blade member is capable of rotating with respect to the structural member, the tip portion of the blade member is provided with stepped parts which have step surfaces facing an upstream side in a rotating axial direction of the structural member, the stepped parts protrude toward the structural member, and the stepped parts are aligned in the rotating axial direction, the structural member is provided with seal fins, each seal fin extending toward a circumference surface of a corresponding one of the stepped parts so as to form a small clearance between each seal fin and the circumference surface of the corresponding stepped part, a first distance between a first one of the seal fins and the step surface of the stepped part corresponding to the first seal fin in the rotating axial direction is longer than a second distance between a second one of the seal fins adjacent to the first seal fin and the step surface of the stepped part corresponding to the second seal fin, wherein the first seal fin is located at the upstream side with respect to the second seal fin, an axial directional width is set between the first seal fin and a wall surface of the structural member facing the upstream side of the first seal fin in the rotating axial direction, a radial directional distance is set between a lower end of the step surface of the stepped part corresponding to the first seal fin and a bottom surface of the structural member provided with the first seal fin, and the axial directional width and the radial directional distance are approximately set to be the same size.

2. The turbine according to claim 1, wherein the first distance is L1, the second distance is L2, a third distance between a third one of the seal fins and the step surface of the stepped part corresponding to the third seal fin in the rotating axial direction is L3, a fourth distance between a fourth one of the seal fins and the step surface of the stepped part corresponding to the fourth seal fin in the rotating axial direction is L4, and a relational expression satisfies L1>L2>L3>L4.

3. The turbine according to claim 2, wherein a first inclined surface inclined from the upstream side toward a downstream side is formed on the step surface of the stepped part corresponding to the first seal fin located at the upstream side with respect to the step surface of the stepped part corresponding to the second seal fin, wherein the first inclined surface communicates with the circumference surface of the stepped part corresponding to the first seal fin.

4. The turbine according to claim 3, wherein second inclined surface inclined from the upstream side toward the downstream side is formed on the step surface of the stepped part corresponding to the second seal fin, wherein the second inclined surface communicates with the circumference surface of the stepped part corresponding to the second seal fin, and a first inclination angle of the first inclined surface is smaller than a second inclination angle of the second inclined surface.

5. A turbine comprising:

a blade member; and a structural member located close to the blade member such that a clearance is provided between a tip portion of the blade member and the structural member, and fluid passes through the clearance, wherein the blade member is capable of rotating with respect to the structural member, the tip portion of the blade member is provided with stepped parts which have step surfaces facing an upstream side in a rotating axial direction of the structural member, the stepped parts protrude toward the structural member, and the stepped parts are aligned in the rotating axial direction, the structural member is provided with seal fins, each seal fin extending toward a circumference surface of a corresponding one of the stepped parts so as to form a small clearance between each seal fin and the circumference surface of the corresponding stepped part, a first distance between a first one of the seal fins and the step surface of the stepped part corresponding to the first seal fin in the rotating axial direction is longer than a second distance between a second one of the seal fins adjacent to the first seal fin and the step surface of the stepped part corresponding to the second seal fin, wherein the first seal fin is located at the upstream side with respect to the second seal fin, a first inclined surface inclined from the upstream side toward a downstream side is formed on the step surface of the stepped part corresponding to the first seal fin located at the upstream side with respect to the step surface of the stepped part corresponding to the second seal fin, wherein the first inclined surface communicates with the circumference surface of the stepped part corresponding to the first seal fin, a second inclined surface inclined from the upstream side toward the downstream side is formed on the step surface of the stepped part corresponding to the second seal fin, wherein the second inclined surface communicates with the circumference surface of the stepped part corresponding to the second seal fin, and a first inclination angle of the first inclined surface is smaller than a second inclination angle of the second inclined surface.

6. The turbine according to claim 5, wherein the first distance is L1, the second distance is L2, a third distance between a third one of the seal fins and the step surface of the stepped part corresponding to the third seal fin in the rotating axial direction is L3, a fourth distance between a fourth one of the seal fins and the step surface of the stepped part corresponding to the fourth seal fin in the rotating axial direction is L4, and a relational expression satisfies L1>L2>L3>L4.

* * * * *